US005795312A

United States Patent [19]

Dye

[11] Patent Number: 5,795,312

[45] Date of Patent: Aug. 18, 1998

[54] COMPRESSION SLEEVE

[75] Inventor: John F. Dye, Bridgewater, Mass.

[73] Assignee: The Kendall Company, Mansfield, Mass.

[21] Appl. No.: 617,978

[22] Filed: Mar. 15, 1996

Related U.S. Application Data

[63] Continuation of Ser. No. 127,019, Sep. 27, 1993, abandoned.

[51] Int. Cl.[6] ..... A61H 9/00

[52] U.S. Cl. ..... 601/151; 601/152; 128/DIG. 20

[58] Field of Search ..... 601/15, 148–152; 602/13; 128/DIG. 20

[56] References Cited

U.S. PATENT DOCUMENTS

| | | | |
|---|---|---|---|
| 4,355,632 | 10/1982 | Sandman | 601/152 |
| 4,372,297 | 2/1983 | Perlin | 601/151 |
| 4,402,312 | 9/1983 | Villari et al. | 601/152 |
| 4,597,384 | 7/1986 | Whitney | 601/152 |
| 4,674,479 | 6/1987 | Jennings et al. | 128/DIG. 20 |
| 5,146,932 | 9/1992 | McCabe | 602/23 |
| 5,267,951 | 12/1993 | Ishii | 602/26 |

FOREIGN PATENT DOCUMENTS

| | | | |
|---|---|---|---|
| 2583978 | 1/1987 | France | 601/152 |

*Primary Examiner*—Jeanne M. Clark
*Attorney, Agent, or Firm*—David J. Koris

[57] ABSTRACT

Disclosed is a compression sleeve for use in systems for applying compressive pressure to a patient's leg. The sleeve has an improved design for facilitating proper placement on the leg and for providing increased comfort for the patient wearing the sleeve.

13 Claims, 4 Drawing Sheets

COMPRESSION SLEEVE

This application is a continuation of application Ser. No. 08/127,019, filed Sep. 27, 1993, now abandoned.

BACKGROUND OF THE INVENTION

The present invention relates to a novel compression sleeve for use in per se known systems for applying compressive pressure to a patient's leg. Prior to the present invention, various compression devices have been known in the art for applying compressive pressure to a patient's limbs in order to increase blood flow velocity. Particularly useful are the SCD (trademark of The Kendall Company, assignee of the present invention) sequential compression devices providing intermittent pulses of compressed air which sequentially inflate multiple chambers in a sleeve, beginning at the ankle and moving up the leg. This results in a wave-like milking action which empties the veins and results in greatly increased peak blood flow velocity, thus providing a non-invasive method of prophylaxis to reduce the incidence of deep vein thrombosis (DVT). These compression devices find particular use during surgery on patients with high risk conditions such as obesity, advanced age, malignancy, or prior thromboembolism. When a DVT occurs, the valves that are located within the veins of the leg can be damaged, which in turn can cause stasis and high pressure in the veins of the lower leg. Patients who have this condition often have swelling (edema) and tissue breakdown (venous stasis ulcer) in the lower leg.

Devices of the foregoing description are disclosed in various patents of which the following are illustrative: U.S. Pat. Nos. 4,013,069 and 4,030,488 of James H. Hasty, and U.S. Pat. No. 4,029,087 of the instant inventor, John F. Dye, all assigned to The Kendall Company.

As examples of other patents directed to compression sleeves for use in these systems, mention may be made of the following: U.S. Pat. Nos. 4,091,804; 4,156,425; 4,198,961; and 4,207,875.

In general, the compression devices of the prior art comprise a sleeve having a plurality of separate fluid pressure chambers progressively arranged longitudinally along the sleeve from a lower portion of the limb to an upper portion. Means are provided for intermittently forming a pressure pulse within these chambers from a source of pressurized fluid during periodic compression cycles. Preferably, the sleeve provides a compressive pressure gradient against the patient's limbs during these compression cycles which progressively decreases from the lower portion of the limb, e.g. from the ankle to the thigh.

Sequential pneumatic compression devices of the foregoing description applying compression to the lower limb have achieved considerable notoriety and wide acceptance as an effective non-invasive means for preventing deep vein thrombosis and for treating venous stasis ulcers.

They function by applying pneumatic compression sequentially and in gradient levels from ankle to thigh for a predetermined time, e.g. 11 seconds, followed by a period of time, e.g. 60 seconds, when no pressure is applied. The particular time period selected is chosen to be optimum for pushing venous blood out of the leg (during the compression cycle) and to allow arterial blood to refill the leg (during the decompression interval).

While the compression devices of the prior art for applying compressive pressure to the leg have enjoyed great commercial success and the clinical efficacy of the SCD devices in particular has been well documented, there nevertheless remains a need in the art for a sleeve of improved design for facilitating proper placement on the leg and for increased comfort to the patient wearing the sleeve.

Stated simply, the task of this invention is to provide such an improved sleeve design.

BRIEF DESCRIPTION OF THE INVENTION

In accordance with this invention, this task is solved by providing a compression sleeve of generally known construction preferably having a plurality of fluid pressure chambers arranged progressively from the ankle region of the leg to an upper region and having a plurality of conduits leading to these chambers for intermittently inflating and deflating these chambers during successive compression cycles, the sleeve having a novel symmetrical design facilitating proper placement on the leg as well as features to be discussed in detail hereinafter contributing to a patient's comfort when wearing the sleeve.

DETAILED DESCRIPTION OF THE INVENTION

As was heretofore mentioned, the present invention is directed to a new and improved compression sleeve for use in per se known systems for applying compressive pressure against a patient's leg.

The nature and objects of the invention will be readily understood by reference to the following detailed description in conjunction with the accompanying illustrative drawings.

Figure 1:
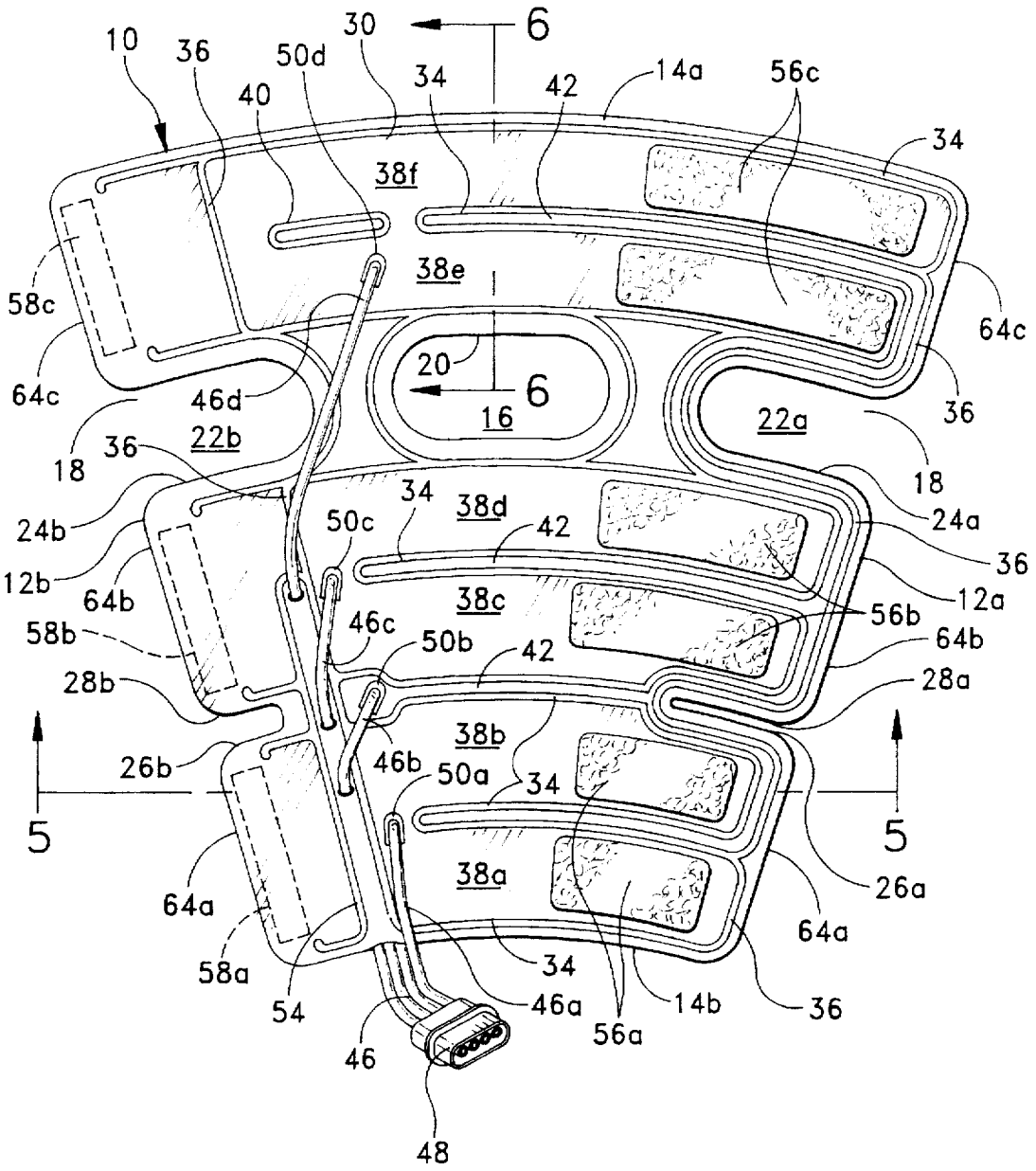
FIG. 1 is a plan view of the outer surface of the sleeve.

As shown therein with reference in particular to FIG. 1, the sleeve 10 has its shape and dimensions defined by a pair of opposed side edges 12*a,b* and a pair of end edges 14*a,b* connecting the side edges, with the side edges 12*a* and 12*b* being tapered from an upper end adapted to enclose the thigh region toward a lower end for enclosing the ankle region of a patient.

The sleeve has an elongated opening 16 extending through what would be the knee region 18 when the sleeve is applied to apply compressive pressure to the leg, opening 16 being defined by peripheral edges 20 extending around the opening. In addition, the knee region 18 has elongated cut-outs or openings 22*a* and 22*b* on opposed side edges 12*a* and 12*b*, respectively, the openings 12*a* and 12*b* being defined by peripheral side edges 24*a* and 24*b*, respectively.

Additionally, for reasons which will be discussed hereinafter, the sleeve has cut-outs or openings 26*a* and 26*b* defined by peripheral edges 28*a* and 28*b* on opposed side edges 12*a* and 12*b*, respectively.

The sleeve has an outer fluid-impervious sheet 30 (FIG. 1) and an inner fluid-impervious sheet 32 (FIG. 2) adapted for placement against the leg of a patient, sheets 30,32 are connected by a plurality of laterally extending sealing lines 34 and longitudinally extending sealing lines 36 connecting ends of the lateral lines 34, as shown. The sealing lines, which may, for example, be provided by heat-sealing, adhesive, radio frequency ("R.F.") welding, etc., define a plurality of longitudinally disposed chambers 38*a*, 38*b*, 38*c*, 38*d*, 38*e* and 38*f* which in per se known manner are capable of retaining pressurized air in order to exert compressive pressure to the leg during successive pressure-applying cycles. The outer sheet 30 may, for example, comprise a suitable flexible polymeric material such as polyvinyl chloride (PVC) on the order of 5–10 mils thick. The inner sheet 32 will preferably comprise a similar polymeric material, e.g. 5–10 mil PVC having laminated to the inner surface to be placed against the leg a non-woven material such as polyester for added comfort to the wearer.

When positioned around the leg, chambers 38*a* and *b* will apply compressive pressure to the ankle region; chambers 38*c* and *d* to the calf region; as heretofore noted openings 16, 22*a* and 22*b* will be in the knee region to enhance flexibility; and chambers 38*e* and *f* will apply compressive pressure to the thigh region.

While not essential to the practice of this invention, as shown in FIG. 1 an annular seal 40 is preferably provided in the thigh region for purposes of completing the separation of the thigh region into lower and upper chambers 38*e* and *f* as the calf region is to lower and upper chambers 38*c* and *d*, and the ankle region in lower and upper chambers 38*a* and *b*.

In known manner, the sleeve is provided with conduits 46*a*, 46*b*, 46*c* and 46*d* collectively providing a set of conduits 46 having a connector 48 for connecting the conduits to a controller (not shown) having a source of pressurized air. A tubing channel 52 defined by an inner seal line 36 and an outer seal line 54 is provided through which the conduits extend and then terminate at their trailing ends where ports 50*a*, 50*b*, 50*c* and 50*d* are provided for conducting air into the sleeve.

As shown, conduit 46*a* leads into the ankle chambers, conduit 46*c* into the calf chambers, and conduit 46*d* into the thigh chambers.

Figure 2:
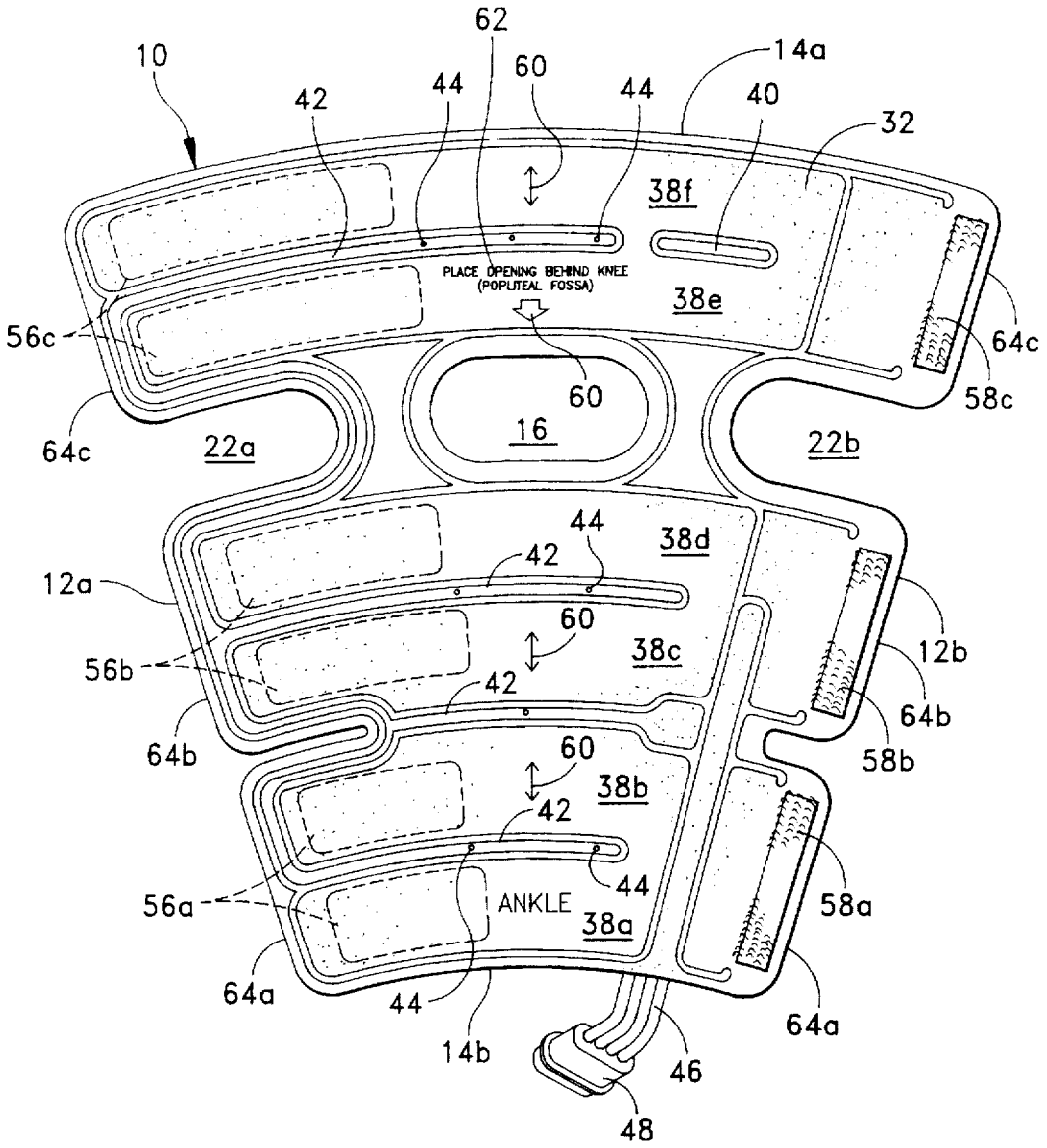
FIG. 2 is a plan view of the inner surface to be applied against the leg.
Figure 3:
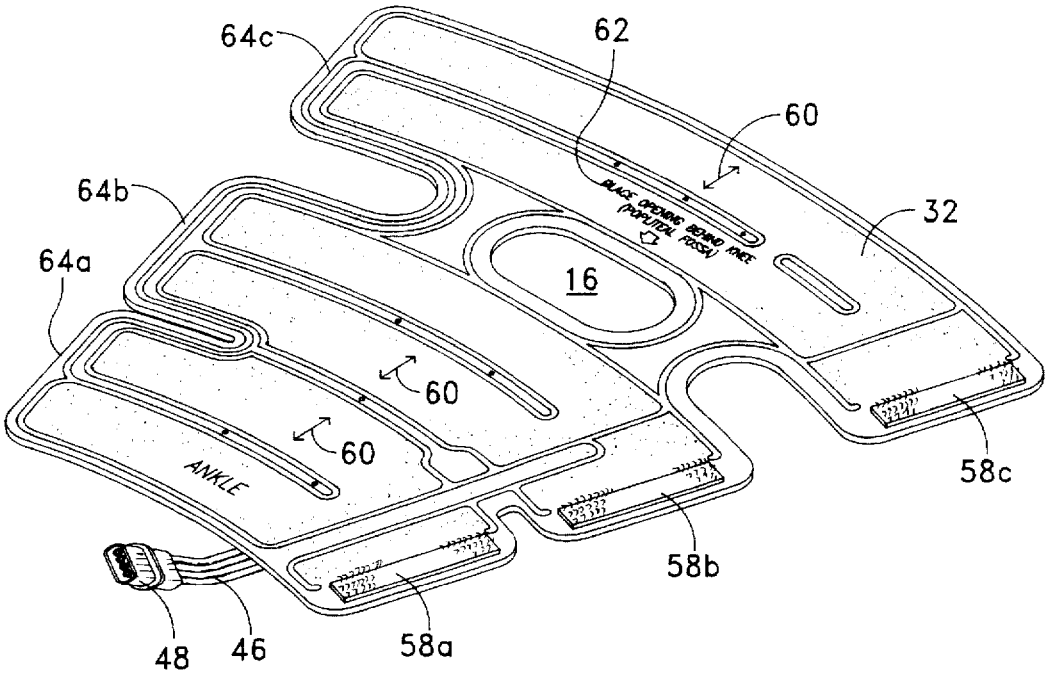
FIG. 3 is a perspective view of the inner surface of the sleeve.

Conduit 46*b* leads into a ventilation channel 42 which, as best seen in FIG. 2, extends throughout the compression chambers and is provided with apertures or small openings 44 on the inner sheet for the known function of cooling the leg and thus contributing to the general comfort of the wearer.

Figure 4:
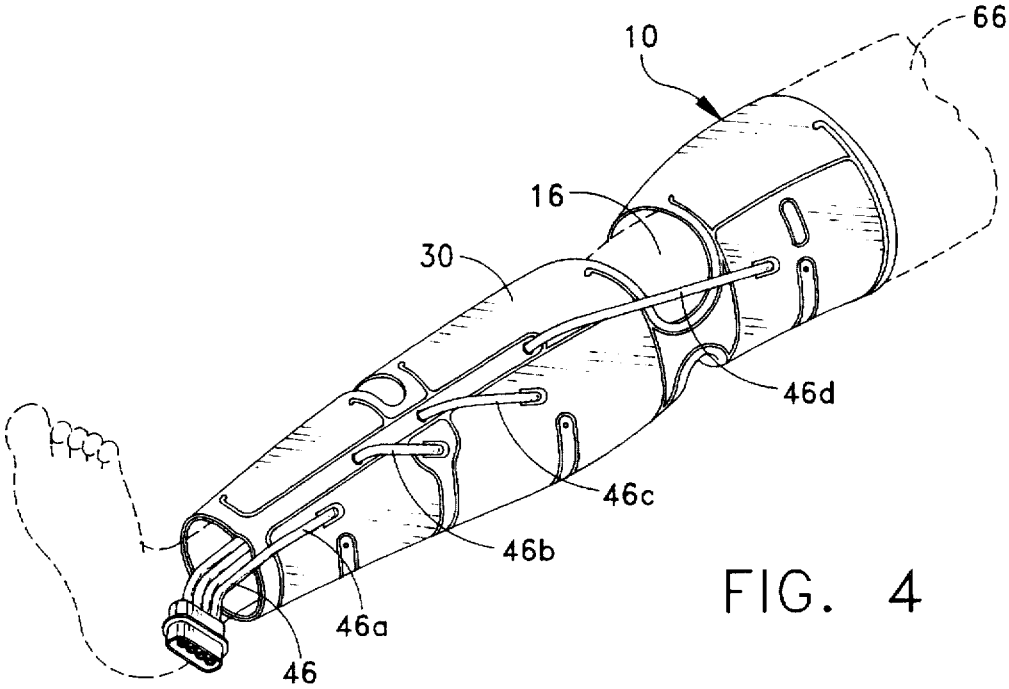
FIG. 4 is an applied perspective view showing the sleeve wrapped around the leg.
Figure 5:
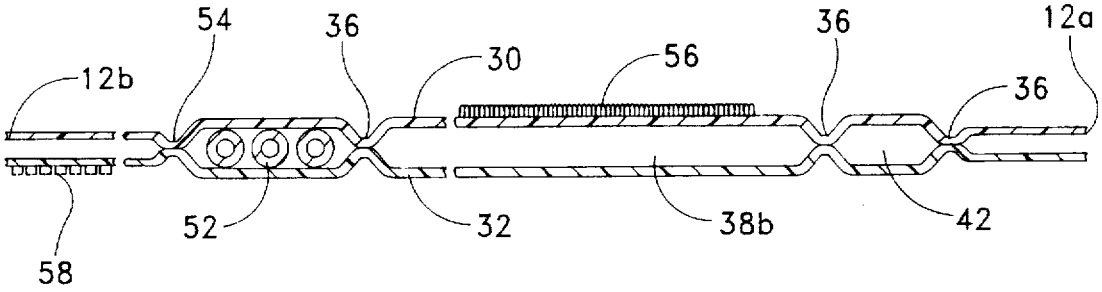
FIG. 5 is a sectional view taken along line 5—5 in FIG. 1.
Figure 6:
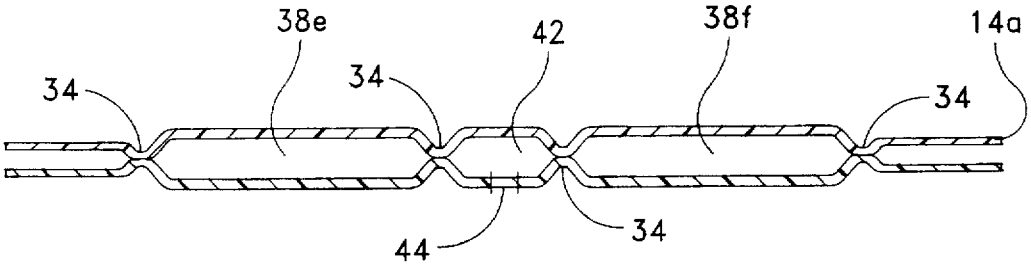
FIG. 6 is a sectional view taken along line 6—6 in FIG. 1.

The outer sheet 30 has a set of spaced strips 56*a*, 56*b* and 56*c*, such as loop material sold under the trademark "VELCRO", extending laterally at the ankle, calf and thigh chambers and cooperating with a set of spaced "VELCRO" hook material 58*a*, 58*b* and 58*c* on the inner sheet for releasably fastening the sleeve encircling the leg, as seen in FIG. 4.

As will be appreciated, wide variations may be found in the proportions of the ankle, calf and thigh regions in a patient's leg. One may, for example, have relatively thin ankles and proportionally thicker thighs or overdeveloped calf muscles, as might be the case with athletes.

For this reason, an important feature of this invention is the design providing opposed flaps 64*a*, 64*b* and 64*c*, each having its own cooperating Velcro loop and hook materials 56*a–c* and 58*a–c*, respectively, so that each of the ankle, calf and thigh chambers may be individually and selectively adjusted around the leg to accommodate the particular shape and thicknesses of the individual's ankle, calf and thigh.

The SCD sleeves currently commercially available and shown in the patent literature such as those patents mentioned above are not symmetrical in the sense that the knee opening 16 is centrally disposed. This is because the sleeve design is such that when properly positioned on the leg it is fastened on the side.

For proper alignment on the leg some degree of experience by the clinician is required. For this reason, the high turnover in attending clinicians presents a problem in positioning the sleeve properly encircling the leg.

Another important feature of the present invention is the symmetrical design and indicia making it easy for inexperienced clinicians to apply the compression sleeve to a patient.

With reference to FIGS. 2 and 4, for proper alignment, with the patient lying down the sleeve is placed under the patient's leg with the inner surface 32 against the leg such that the arrows 60 are aligned substantially centrally behind the leg.

Figure 7:
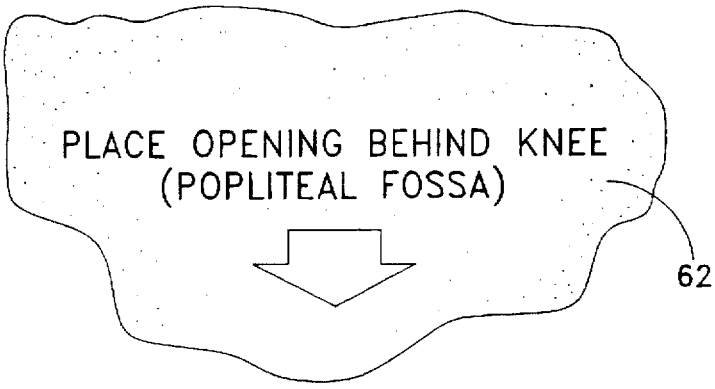
FIG. 7 is an enlarged view showing the illegible indicia in FIG. 2.

With reference to FIGS. 2 and 7, the sleeve may then be adjusted vertically as directed by indicia 62, and while maintaining proper alignment of the arrows 60 so that opening 16 is placed behind the knee (popliteal fossa). When so positioned, the lowest portion of the sleeve designated "ANKLE" will then be in the ankle region of the patient's leg.

The sleeve may then be secured around the leg in the manner heretofore described by superposing the flaps 64 so that the VELCRO strips 56,58 secure the sleeve in place. When so secured, openings 22*a* and 22*b* are brought together to form an elongated opening over the knee.

By way of recapitulation, the present invention provides a compression sleeve affording significant advantages over the current state of the art.

The symmetrical design with the accompanying indicia makes it very easy for even new or inexperienced personnel to apply the sleeve properly. Rather than reliance on accompanying brochures or other literature instructing the clinician, which literature is often not available or, if available, not read, each individual sleeve contains indicia clearly directing the placement of the sleeve.

The centralized opening 16 behind the knee provides improved flexibility and hence increased comfort over that obtained simply by a knee opening over the knee, e.g. the opening provided by bringing openings or cut-outs 22*a* and *b* together when securing the sleeve on the leg.

Another important feature is the provision of the flaps 64*a*,*b* and *c* permitting proper adjustment of each of the ankle, calf and thigh chambers individually so as to accommodate the particular shape and contour of the patient's leg and thereby, in turn, assuring that the proper preselected pressure profile is applied to the leg by the individual compression chambers. As will be appreciated, the flaps also greatly facilitate the readjustments which may be required for proper fitting by permitting selective separation of less than all of the flaps from the mating loop strips 56.

As will be appreciated by those skilled in the art, the novel compression sleeve shown in the illustrative drawings and described in the foregoing specification can be employed with the SCD Controllers and tubing sets known in the art and currently commercially available to apply a sequential compressive gradation to the leg.

In use, after placement of the sleeve(s) on the patient's leg(s) and connection to the controller by the tubing set, the controller may then be initiated in order to supply air to the sleeve(s). In known manner, the controller intermittently inflates the ankle chambers 38*a,b*, then the calf chambers 38*c,d*, and finally thigh chambers 38*e,f*, sequentially during periodic compression cycles in a pressure gradient profile which decreases from the lower or ankle portion of the sleeve to the upper or thigh portion of the sleeve.

Deflation between successive inflation cycles occurs in known manner by return of air through the conduits 46 to the controller where it is then vented to the atmosphere through and exhaust tube.

As mentioned, the controller also supplies air through conduit 46*b* into ventilation channels 42 where it then passes through apertures 44 in the ventilation channels onto the patient's legs. In this manner, the sleeve 10 ventilates a substantial portion of the legs to prevent heat buildup and thereby provide comfort from the cooling effect during the extended periods of time in which the sleeves are normally retained in a wrapped configuration about the patient's legs.

It will be appreciated that the novel compression sleeves of this invention are not limited to the preferred design shown in the illustrative drawings.

Conceptually, sleeves for applying compressive pressure to the legs are known in the art which have a single inflatable chamber or a lesser number of chambers than the sleeve shown in the drawings. Likewise, compression sleeves are known which have but a single conduit into the sleeve from a source of pressurized air. Also, it will be appreciated that the conduit providing cooling air to a ventilating chamber is not necessary to the practice of this invention. Other changes without departing from the scope of this invention will be readily suggested in the light of the foregoing detailed description and may accordingly be a matter of individual whim or desire.

Since certain changes may therefore be made without departing from the scope of this invention, it shall be understood that the foregoing description and illustrative drawings shall be taken as being illustrative and not in a limiting sense.

What is claimed is:

1. In a device for applying compressive pressure against a patient's leg from a source of pressurized fluid comprising an elongated sleeve for enclosing a length of the patient's leg, the sleeve having a pair of opposed side edges and a pair of opposed end edges connecting the side edges, the side and end edges together defining the shape and dimensions of the sleeve, at least one pressure chamber within the sleeve, conduit means for introducing the pressurized fluid within the chamber(s) of the sleeve, and fastening means extending longitudinally along the side edges for releasably securing the sleeve surrounding the leg;

the improvement wherein the side edges of the sleeve are provided with a plurality of pairs of opposed flaps extending longitudinally between the end edges of the sleeve, the flaps being integrally formed with the sleeve and defined by cut out regions in the side edges, one of each pair of flaps being on one of the side edges and the other flap of each pair being on the other side edge of the sleeve, each of the pairs of flaps having closure means mating with closure means on the opposed flap of the pair, the pairs of flaps and their associated closure means being located to be individually adjustable and securable together to provide differing circumferential dimensions when the sleeve is secured surrounding the leg to accommodate the thickness of the particular leg region enclosed by the pair of flaps, thereby permitting proper fitting of the sleeve around the leg for applying the proper preselected pressure profile; and wherein the sleeve has a first opening symmetrically located between the side edges of the sleeve for placement substantially centrally behind the knee and a second opening defined by the cut out regions symmetrically placed in the side edges of the sleeve and adapted for placement substantially centrally over the knee cap when the sleeve is wrapped around the leg and wherein opposed ends of at least one of the chambers extend into the flaps of one of the pairs of opposed flaps.

2. A device as defined in claim 1 wherein the closure means in one flap in each pair of flaps comprises a hook fastening material and the other flap in each pair comprises a loop fastening material.

3. A device as defined in claim 2 wherein one of the hook fastening material and the loop fastening material extends longitudinally parallel to the end edges to provide a plurality of locations for adjusting and securing the closure means.

4. The device of claim 1 wherein the sleeve has a plurality of compression chambers extending upwards from the ankle region of the leg, each chamber having an associated pair of flaps.

5. A device of claim 1 wherein the opposed side edges are tapered from one of the end edges to the other of the end edges to provide a first width to enclose a thigh region, a second width less than the first width to enclose an ankle region, and a third width intermediate the first and second widths to enclose a calf region, the pairs of flaps being associated with the first, second, and third widths respectively.

6. A device for applying compressive pressure against a patient's leg from a source of pressurized fluid comprising:

an elongated sleeve for enclosing a length of the patient's leg, the sleeve having a pair of opposed side edges and a pair of opposed end edges connecting the side edges, the side and end edges together defining the shape and outer dimensions of the sleeve, and at least one pressure chamber within the sleeve;

conduits for introducing the pressurized fluid within the chamber(s) of the sleeve; and a plurality of pairs of opposed flaps extending longitudinally between the end edges of the sleeve, one flap of each pair of flaps being on one of the side edges and the other flap of each pair being on the other side edge of the sleeve, the flaps of adjacent pairs of flaps being separated by opposed cut out regions in the side edges of the sleeve, each of the pairs of flaps having a closure member mateable with an associated closure member on the opposed flap of the pair, the pairs of flaps and their associated closure members being located to be individually adjustable and securable together to provide differing circumferential dimensions when the sleeve is secured surrounding the leg to accommodate the thickness of the particular leg region enclosed by the pair of flaps, thereby permitting proper fitting of the sleeve around the leg for applying the proper preselected pressure profile;

a first opening symmetrically located between the side edges of the sleeve for placement substantially centrally behind the knee, and at least one set of the opposed cut out regions being symmetrically located to define a second opening for placement substantially centrally over the knee cap when the sleeve is wrapped around the leg; and a tubing channel through which the conduits extend, the tubing channel spaced inwardly from at least two of the flaps on one of the side edges and extending longitudinally from one end edge past another of the cut out regions separating the at least two flaps.

7. The device of claim 6, wherein the cut out regions are located to define an opening for placement between an ankle region and a calf region, the pairs of flaps being associated with the ankle region and the calf region respectively.

8. A device of claim 6, wherein the opposed side edges are tapered from one of the end edges to the other of the end edges to provide a first width to enclose a thigh region, a second width less than the first width to enclose an ankle region, and a third width intermediate the first and second widths to enclose a calf region, the pairs of flaps being associated with the first, second, and third widths respectively.

9. The device of claim 6, wherein the closure member of one flap in each pair of flaps comprises a hook fastening material and the associated closure member of the other flap in each pair of flaps comprises a loop fastening material.

10. The device of claim 9, wherein one of the hook fastening material and the loop fastening material extends longitudinally parallel to the end edges to provide a plurality of locations for securing the flaps to provide a plurality of circumferences.

11. The device of claim 6, wherein the sleeve includes a plurality of compression chambers extending upwardly from the ankle region of the leg, each chamber having an associated pair of flaps.

12. The device of claim 6, wherein the sleeve comprises an inner sheet adapted for placement against the leg and an outer sheet, the sheets being sealed together in fluid-tight arrangement to provide the compression chamber(s), the outer surface of the inner sheet having indicia indicating to a clinician applying the sleeve to a patient proper alignment of the sleeve behind the patient's leg.

13. The device of claim 6, wherein the sleeve has a first opening symmetrically located between the side edges of the sleeve for placement substantially centrally behind the knee, and the cut out regions define a second opening adapted for placement substantially centrally over the knee cap when the sleeve is wrapped around the leg, and the sleeve further includes indicia on an inner surface of the sleeve adapted for placement against the leg, the indicia defining placement of the first opening behind the knee or popliteal fossa when the sleeve is wrapped around the leg.

* * * * *